United States Patent [19]

Kanzelberger

[11] 4,384,416

[45] May 24, 1983

[54] FRAME AND METHOD OF FRAMING

[75] Inventor: James C. Kanzelberger, Riverside, Ill.

[73] Assignee: Contemporary, Inc., Riverside, Ill.

[21] Appl. No.: 209,753

[22] Filed: Nov. 24, 1980

[51] Int. Cl.[3] ..... G09F 3/18; A47G 1/06; G09F 1/10

[52] U.S. Cl. ..... 40/10 D; 40/158 R; 40/159

[58] Field of Search ..... 40/10 R, 10 C, 10 D, 40/158 R, 124.4, 594, 152.1, 158 A, 158 B, 152, 156; 434/87, 88, 90, 102, 81; 33/174 G, 1 G, 1 SD

[56] References Cited

U.S. PATENT DOCUMENTS

| | | | |
|---|---|---|---|
| 762,787 | 6/1904 | Wheeler | 40/158 R |
| 1,679,927 | 8/1928 | Bell et al. | 434/90 |
| 2,494,536 | 1/1950 | Atwood | 33/1 SD |
| 2,540,951 | 2/1951 | Kellems | 40/10 D |
| 2,844,901 | 7/1958 | Eisen | 40/158 R |
| 3,299,557 | 1/1967 | Schultz | 40/158 R |
| 3,333,357 | 8/1967 | Grogan | 40/158 R |
| 3,464,135 | 9/1969 | Eidinger | 40/10 R |
| 3,687,770 | 8/1972 | Chase | 40/158 R |
| 3,836,419 | 9/1974 | Hamberger | 40/124.4 |
| 4,051,615 | 10/1977 | Gosanko et al. | 40/10 D |
| 4,057,923 | 11/1977 | Chase | 40/158 R |
| 4,200,222 | 4/1980 | Fener | 40/594 |
| 4,215,497 | 8/1980 | Levy | 40/10 D |
| 4,242,817 | 1/1981 | Ballard | 40/10 D |

*Primary Examiner*—Gene Mancene
*Assistant Examiner*—Michael J. Foycik, Jr.
*Attorney, Agent, or Firm*—Laff, Whitesel, Conte & Saret

[57] ABSTRACT

A device and method for framing and displaying pictures or printed matter uses a transparent carrier panel and a bracket or affixed to the back of the panel for retaining a picture. A mat may be applied to the panel to block out a portion of the picture to be displayed. The portion of the picture to be displayed is centered within the mat by applying a clear centering sheet having a target area designated thereon over the picture so that the desired portion of the picture appears within the target area. A mounting board of the same size as the centering sheet and containing pressure sensitive adhesive is aligned with the centering sheet and fixed to the back of the picture. A picture so centered and mounted is inserted between the bracket and the rear face of the carrier panel resulting in a perfectly centered and matted picture which is attractively framed.

8 Claims, 5 Drawing Figures

FRAME AND METHOD OF FRAMING

BACKGROUND OF THE INVENTION

This invention relates to a new and unique device and method whereby photographs, pictures or other printed matter may be easily and attractively framed. The term "picture" will be used hereafter to designate any form of matter suitable for framing and should not be considered as limiting the scope of this invention. The device allows the user to quickly, easily, and accurately center a picture or other material within the frame.

Heretofore, the art of decorative framing typically involved the selection of a style of framework which was cut to the desired size according to the picture size and then assembled. The framework was designed to contain a pane of glass or some other transparent material to protect the picture. If the user wanted to frame a picture which had a larger field than he wished displayed, he had to crop out the unwanted regions of the picture, such as by using a mat between the picture and glass. This involved cutting the mat to the proper size and centering the desired region of the picture within the cut-out area in the mat. Usually such a centering process involved a number of attempts at positioning the picture before the desired result was achieved. Such a procedure was invariably expensive and time consuming, because a number of pieces had to be purchased, cut, and fit together.

Another problem in the art of decorative framing is the difficulty and expense in incorporating unusual designs into the frame or matting. Decorative designs enhance the beauty of a frame, and the application of designs such as company logos in the frame or matting is desired by the public.

Accordingly, an object of this invention is to provide an inexpensive and expeditious method and device for matting and framing pictures.

A further object of this invention is to provide a device which allows the imprinting of advertising or designs on its face.

Further objects will be apparent from the description, drawings and claims.

SUMMARY OF THE INVENTION

In keeping with one aspect of the invention, a self-matting frame comprises a carrier panel, a picture carrier, an overlay, and a picture centering assembly. The carrier panel is preferably a sheet of clear acrylic, supported in an upright position by a foot which projects from the sheet. Attached to the front or back face of the carrier panel is an overlay or mat with a cut-out region in its center to mat the picture to be framed. If attached to the front face of the carrier panel, the overlay may be formed from a decorative laminate which is debossed, imprinted, or engraved by a hot stamp process. The picture carrier is a bracket attached along the lower most region and rear face of the carrier panel to hold a picture.

The picture centering assembly includes a clear centering sheet and a mounting board, both of which are of identical size. The centering sheet is imprinted with one or more target areas that correspond to the cut-out region in the overlay. The centering sheet is applied over the picture and the desired portion of the picture is centered in one of the target areas. A mounting board having pressure sensitive adhesive is placed behind the picture in alignment with the centering sheet. The picture is then fixed to the mounting board and any excess is trimmed away. So mounted, the picture is inserted between the rear face of the carrier frame and the picture carrier.

DETAILED DESCRIPTION OF THE INVENTION

Figure 1:
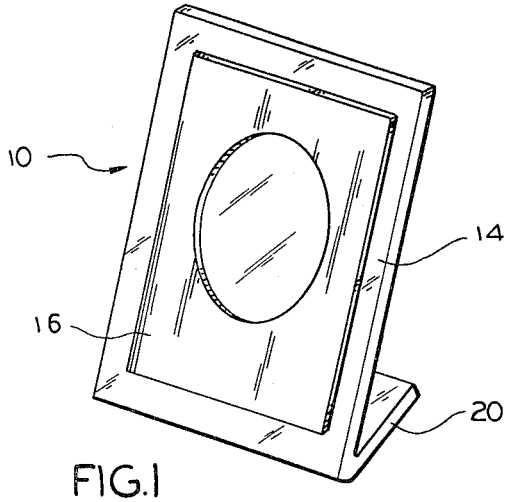
FIG. 1 is a front perspective view of one embodiment of the invention.
Figure 2:
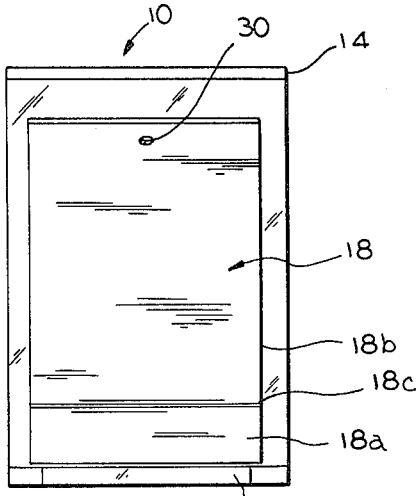
FIG. 2 is a rear view of the embodiment of FIG. 1.
Figure 3:
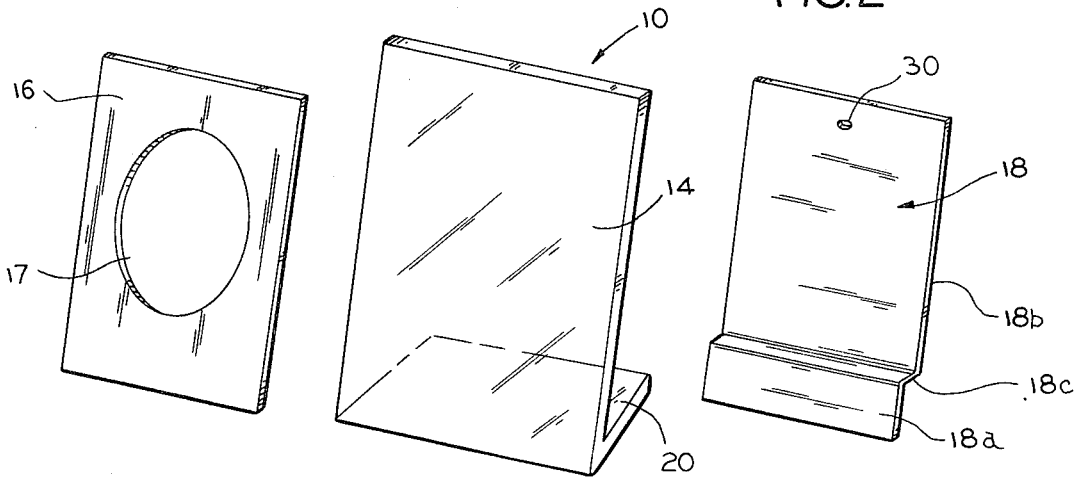
FIG. 3 is an exploded view of the embodiment of FIG. 1.
Figure 4:
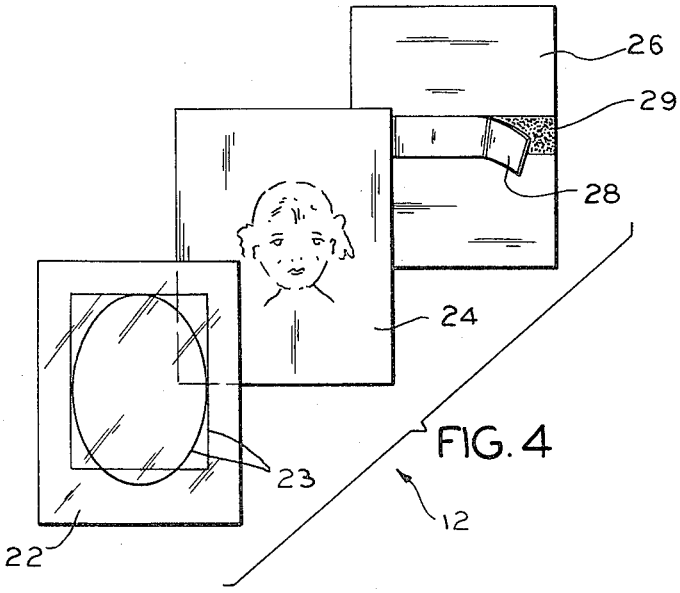
FIG. 4 is an exploded view of the picture centering assembly with a sample picture.

FIGS. 1–5 show the preferred embodiment of a self-matting frame 10. The frame 10 includes a free standing carrier panel 14, an overlay 16 containing a cut-out region 17, and a bracket 18 for supporting photographs, pictures, or the like. The frame 10 also includes a picture centering assembly 12 comprising a clear centering sheet 22 imprinted with a number of target areas 23, and a mounting board 26 which is identical in size to the centering sheet 22 and has a pressure sensitive adhesive 29 on one surface which is covered by a protective strip 28.

Centering sheet 22 may be acetate, Mylar, glass, Lucite, or similar suitably transparent material. An acetate film of 3 to 5 millimeters in thickness has been found particularly suitable. A picture or other article 24 to be framed is visibly centered within the desired target area 23 of the centering sheet 22. Target area 23 may be of any size or shape, but a rectangular area of 2 inches by $2\frac{5}{8}$ inches will crop most snapshots effectively. The target area 23 corresponds in size to the cut-out 17 of overlay 16. While retaining the picture 24 in the desired position with the centering sheet 22, the back of the centered picture is affixed to a mounting board 26 after removing the protective covering 28 and aligning the mounting board 26 and centering sheet 22. By firmly pressing the pressure sensitive adhesive 29 against the back of picture 24, the picture will be mounted on board 26. The picture 24 may be trimmed so that there are no portions overlapping the mounting board 26. The centering sheet and mounting board must both be appropriately sized so that they will fit within the pocket defined by the carrier bracket 18 and panel 14, as described subsequently herein.

In the preferred embodiment, the panel 14 is formed from a clear acrylic plastic sheet which has a foot 20 extending rearwardly and at less than a 90-degree angle from the carrier panel 14 to provide support therefor. Thus constructed, the frame may also be oriented on its side and will stand freely. Alternatively, the panel 14 may be wood or metal with an appropriate size window in it. Attached to the face of the panel 14 by an adhesive is an overlay or crystal 16, which contains a cut-out region 17 and is designed to serve as a mat which will crop out the unwanted areas of the photograph or picture that would otherwise show through the clear panel 14. The overlay 16 may be of various sizes and shapes, provided that it fits on the panel 14, and may also serve as a decorative accent to the frame in that it may be imprinted with advertising, phrases, or logos. A decorative laminate from which a suitable overlay may be formed is described in U.S. Pat. No. 4,125,655 issued Nov. 14, 1978; U.S. Pat. No. 3,940,864 issued Mar. 2, 1976; U.S. Pat. No. 4,047,996 issued Sept. 13, 1977; or pending U.S. patent application Ser. No. 801,863 filed May 31, 1977.

Preferably, such a laminate should be susceptible to debossing or engraving so that it may be imprinted with designs, but any material which will serve to crop or mat the picture to be framed may be used for the overlay.

Instead of affixing the overlay to the front face of the carrier panel 14, the overlay may also be attached to the back face of the panel 14. With this construction, the overlay may preferably be composed of felt, cardboard, or the like.

Figure 5:
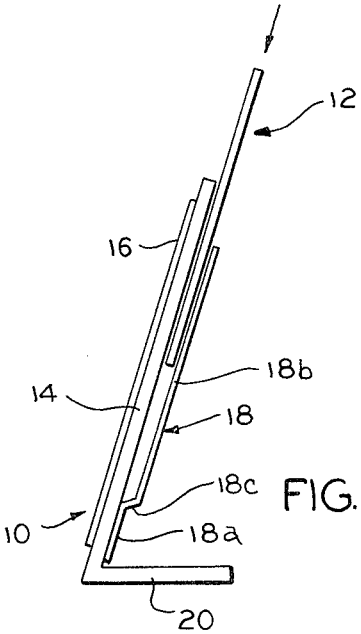
FIG. 5 is a side view of the embodiment of FIG. 1.

In the preferred embodiment, bracket 18 is sheet metal and has a first portion 18*a* which is substantially parallel and affixed to the back, lower region of panel 14; a second portion 18*b* which is generally parallel to and spaced apart from the back surface of panel 14; and a connecting or spacing portion 18*c* integrally formed with the first and second portions. The first portion 18*a* is attached by an adhesive or other suitable means to the rear face of the carrier panel 14, as shown in FIG. 5. Thus, the bracket 18 and the panel 14 form a pocket to hold the centering assembly 12. The second portion 18*b* of bracket 18 may have a hole 30 (shown in FIGS. 2 and 3), or other suitable means, near its top edge for hanging the picture and frame 10 from a wall.

To use the frame 10, the centering assembly 12 is slid between the panel 14 and the bracket 18 as shown in FIG. 5, resulting in an attractively framed picture.

Those who are skilled in the art will perceive how modifications may be made in the disclosed structure. Therefore, the appended claims are to be construed to cover all equivalent structures that may fall within the true scope and spirit of the invention.

I claim:

1. A device for displaying a picture comprising: a generally rectangular substantially flat transparent self-supporting plastic sheet having a transverse fold adjacent one end thereof to define a somewhat L-shaped cross-section with a large panel and a short panel, said short panel forming a foot for supporting the frame, said fold being greater than 90°, whereby said large panel stands upright when said folded sheet is stood on said short panel, said large transparent panel having a bracket affixed to its back surface, said bracket having a first portion affixed to and behind the back of said large panel, and a second portion of said bracket integral with the first portion and spaced apart from the rear of said panel so that the second portion of said bracket and the large panel together form a pocket behind the back of said large transparent panel for receiving a picture which is viewed through the large transparent panel; and a separate opaque mat attached to the front or back surface of the large panel, said opaque mat being a decorative plastic laminate which may be debossed in simulated metal engraving, said mat being positioned in front of said picture and having a cut-out region through which the picture may be displayed, a thin transparent centering sheet with a target area designated thereon corresponding in size to said cut-out region in said mat, said target area being sized and dimensioned to be placed over a desired portion of the picture to be displayed behind said large panel, and a mounting board which is no larger than said pocket and is at least as large as said centering sheet, said mounting board having an adhesive surface for securing said picture to said board, whereby only the desired portion of the picture conforming to said target area is displayed when the mounted picture is inserted between said bracket and said large panel.

2. The device of claim 1 wherein the means on the mounting board for securing the picture to the board is an adhesive strip.

3. The device of claim 2 wherein the holding means is a plate spaced from, and connected to the rear of the panel, and forms a pocket for receiving the mounting board, centering sheet and picture.

4. The device of claim 1 wherein said panel is acrylic and said centering sheet is acetate.

5. The device of claim 1 wherein said bracket includes means for hanging said device from a wall.

6. The device of claim 5 wherein said hanging means is a hole in the second portion of the bracket.

7. A frame comprising: a generally rectangular substantially flat transparent self-supporting plastic sheet having a transverse fold adjacent one end thereof to define a somewhat L-shaped cross-section with a large panel and a short panel, said short panel forming a foot for supporting the frame, said fold being greater than 90°, whereby said large panel stands upright when said folded sheet is stood on said short panel, at least said large panel having an opaque area and a transparent area; bracket means behind and connected to said large panel and spaced therefrom for holding a picture to be displayed through the transparent area of the large panel; a transparent centering sheet with a target area designated thereon corresponding in size to the transparent area of the large panel, said target area to be placed over a desired portion of the picture to be displayed, and a mounting board equal in size to said centering sheet, said mounting board having means for securing said picture to said board with a viewing area positioned within said target area, said bracket and the large panel together form a pocket behind the back of said large transparent panel; whereby only the desired portion of the picture will be displayed when the mounted picture is inserted between the holding means and said panel.

8. The device of claim 7 wherein the panel is transparent and the opaque area is formed by a mat adhered to the panel.

* * * * *